US009399162B2

(12) United States Patent
Lee

(10) Patent No.: US 9,399,162 B2
(45) **Date of Patent: *Jul. 26, 2016**

(54) APPARATUS AND METHOD OF CATCHING A GOLF BALL

(71) Applicant: Joseph Yosup Lee, Buena Park, CA (US)

(72) Inventor: Joseph Yosup Lee, Buena Park, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/507,796

(22) Filed: Oct. 6, 2014

(65) Prior Publication Data

US 2015/0024860 A1 Jan. 22, 2015

Related U.S. Application Data

(63) Continuation of application No. 13/452,806, filed on Apr. 20, 2012, now Pat. No. 8,876,619.

(60) Provisional application No. 61/478,065, filed on Apr. 22, 2011, provisional application No. 61/508,704, filed on Jul. 18, 2011.

(51) Int. Cl.

| | |
|---|---|
| ***A63B 69/36*** | (2006.01) |
| ***A63B 71/02*** | (2006.01) |
| *A63B 63/00* | (2006.01) |

(52) U.S. Cl.

CPC ..... *A63B 69/3623* (2013.01); *A63B 71/022* (2013.01); *A63B 2063/001* (2013.01)

(58) Field of Classification Search

CPC ..... A63B 63/00; A63B 24/0021; A63B 2024/005; A63B 71/022; A63B 69/3623

USPC ..... 473/190–197, 170, 172, 150–156

See application file for complete search history.

(56) References Cited

U.S. PATENT DOCUMENTS

| | | | |
|---|---|---|---|
| 1,166,496 | A | 1/1916 | Torrey |
| 1,677,442 | A | 7/1928 | Hall |
| 2,123,195 | A | 7/1938 | Middleton |
| 2,899,208 | A | 8/1959 | Wallsteiner |
| 3,072,410 | A | 1/1963 | Simjian |
| D205,040 | S | 6/1966 | Bruns |
| 3,420,524 | A | 1/1969 | Cornell et al. |
| 3,655,203 | A | 4/1972 | Gretzky |
| 4,073,491 | A | 2/1978 | Sepaniac |
| 4,132,462 | A | 1/1979 | Hottel, Jr. et al. |
| 4,177,994 | A | 12/1979 | Lindquist |
| 4,303,245 | A | 12/1981 | Brockett |
| 4,489,941 | A | 12/1984 | Shieh |
| 4,511,146 | A | 4/1985 | Windall |
| 4,523,760 | A | 6/1985 | Bednarczuk |
| 4,553,751 | A | 11/1985 | Ketchum |
| 4,809,988 | A | 3/1989 | Hunter |
| 4,905,996 | A | 3/1990 | Tallent et al. |
| 1,430,280 | A | 9/1992 | Bolton |
| 5,251,885 | A | 10/1993 | Logan |
| 5,351,948 | A | 10/1994 | Thomas |

(Continued)

*Primary Examiner* — Mark Graham

(57) ABSTRACT

An apparatus and method for catching a golf ball is disclosed herein. More specifically, the present invention discloses a compact golf ball catching apparatus having a first energy absorbing layer located at a frontal portion of the apparatus, a second energy absorbing layer located at a rear portion of the apparatus, and a frame adapted to connect the first and second energy absorbing layer as well as provide structural integrity to the first energy absorbing layer; wherein the first energy absorbing layer slows down the speed of a golf ball as it enters and penetrates the apparatus and hinders the golf ball's ability from exiting the apparatus post impact.

11 Claims, 16 Drawing Sheets

(56) References Cited

U.S. PATENT DOCUMENTS

| | | | | |
|---|---|---|---|---|
| D353,865 | S | 12/1994 | Smith | |
| 5,549,304 | A | 8/1996 | Davis | |
| 5,569,094 | A | 10/1996 | Macaluso | |
| 5,634,640 | A | 6/1997 | McCarrell | |
| 5,772,537 | A | 6/1998 | Anderson et al. | |
| 5,842,940 | A | 12/1998 | Macaluso | |
| D420,074 | S | 2/2000 | Whitham-Taudien | |
| 6,494,820 | B2 | 12/2002 | Orlando | |
| 6,554,717 | B2 | 4/2003 | Cho | |
| 6,607,455 | B1 | 8/2003 | Petras | |
| 6,860,825 | B2 | 3/2005 | Clark | |
| 6,994,567 | B2 | 2/2006 | Kraemer | |
| 7,021,630 | B1 | 4/2006 | Cho | |
| 7,198,274 | B2 | 4/2007 | Cho | |
| 7,264,245 | B2 | 9/2007 | Cho | |
| 7,614,968 | B1 | 11/2009 | Davies | |
| 8,414,408 | B2 | 4/2013 | Nicora | |
| 8,876,619 | B2 * | 11/2014 | Lee | A63B 69/3623 473/194 |
| 2001/0034271 | A1 | 10/2001 | Nozato | |
| 2006/0226607 | A1 | 10/2006 | Chen | |
| 2009/0191929 | A1 | 7/2009 | Nicora | |
| 2010/0184496 | A1 | 7/2010 | Nicora | |

* cited by examiner

APPARATUS AND METHOD OF CATCHING A GOLF BALL

CROSS-REFERENCE TO RELATED APPLICATION

The present invention is a Continuation of U.S. patent application Ser. No. 13/452,806, filed on Apr. 20, 2012, which claims the benefit of and priority to provisional patent application Ser. No. 61/478,065 filed, Apr. 22, 2011 as well as provisional patent application Ser. No. 61/508,704, filed Jul. 18, 2011, the disclosure of which are all incorporated by reference in their entirety.

FIELD OF THE INVENTION

The present invention relates to a method and apparatus for catching a golf ball. More specifically, the present invention relates to an improved multi-layer apparatus for catching and returning a golf ball comprising of one or more energy absorbing layers.

BACKGROUND OF THE INVENTION

Golf is a popular sport often requiring long hours of practice in order to succeed. Hence, golfers, in order to excel at this sport, often put in numerous hours of practice to try and improve his or her golf game.

Generally speaking, golfers generally practice by hitting golf balls at an outdoor driving range, allowing a golfer to repeatedly hone in on his or her skill by striking a golf ball. Although a driving range provides a great avenue for practice, a trip to the driving range can be quite time-consuming, since one often has to drive the car 10 to 30 minutes to the range and the same time to return home. Often, an additional 30 minutes to an hour is wasted commuting.

In order to provide a golfer more time to practice without the need to go to an outdoor driving range, golf nets have been invented allowing a golfer to practice in a more compact space, often in the golfer's own house or back yard. However, despite the immense advantages the golf net offers when compared to a driving range, it still suffers from several flaws that prevent it from being a popular practicing avenue for your average golfer.

First off, the average golf net suffers from being generally bulky in construction. U.S. Pat. No. 1,430,280 to Bolton shows one of the earlier attempts to create a golf net, and it's bulkiness can be immediately seen from the figures. U.S. Pat. No. 4,511,146 to Windall further illustrates the bulkiness of the modern day golf net when it tries to provide a user with some visual feedback of the golf shot. In fact, in the modern day era, outdoor golf nets can often reach a size of greater than 20 feet in height, making it difficult to be incorporated into a compact environment inside a residence.

Another drawback associated with the common golf net is that it requires extensive assembly and disassembly in order to prepare the apparatus for use. This is especially prevalent in situations wherein space is at a premium, and a bulky golf net can not just be left there without hindering the everyday activities of a residential family. Due to the often cumbersome process, it will often prohibit and discourage a golfer from practicing due to the lengthy time spent with assembly and disassembly.

Finally, another drawback associated with the common golf net is that it is often very fragile due to the netting used to catch the golf ball, requiring the golf net to be replaced frequently. This short life cycle of the common golf net not only discourages a golfer from practicing, it often prohibits a golfer from even purchasing a golf net.

Hence, as it can be seen from above, despite all the attempts in addressing the need of a golfer to get in the necessary practice via a golf net, the current art falls short in providing a suitable solution for giving the everyday golfer a compact, durable, and non-cumbersome practicing device.

BRIEF SUMMARY OF THE INVENTION

One aspect of the present invention is a golf ball catching apparatus comprising a first energy absorbing layer located at a frontal portion of the golf ball catching apparatus, a second energy absorbing layer located at a rear portion of the golf ball catching apparatus, and a frame adapted to connect the first and second energy absorbing layers via a perimeter of the golf ball catching apparatus, wherein the frame provides structural integrity to the first energy absorbing layer.

Another aspect of the present invention is a golf ball catching apparatus comprising a first energy absorbing layer located at a frontal portion of the golf ball catching apparatus, a second energy absorbing layer located at a rear portion of the golf ball catching apparatus, wherein the second energy absorbing layer absorbs more energy than the first energy absorbing layer, and wherein the material used to form the second energy absorbing layer has a mass of greater than about 1.2 kg over a projected area of 1 meter squared A further aspect of the present invention is a golf ball catching apparatus comprising a first energy absorbing layer located at a frontal portion of the golf ball catching apparatus, a second energy absorbing layer located at a rear portion of the golf ball catching apparatus, wherein the second energy absorbing layer is created from a material that absorbs and reduces the rebound energy of a golf ball, and wherein the first energy absorbing layer further comprises a plurality of strands, wherein a tension within the plurality of strands are selected to slow down a golf ball when a struck golf ball initially penetrates the first energy absorbing layer, and so as to hinder the struck golf ball from re-penetrating the first energy absorbing layer after rebounding off the second energy absorbing layer.

These and other features, aspects and advantages of the present invention will become better understood with reference to the following drawings, description and claims.

BRIEF DESCRIPTION OF THE DRAWINGS

The following drawings form part of the specifications and are included to additional demonstrate the various aspects of different embodiments. The various embodiments may be better comprehended with the detailed description of these specific embodiments.

DETAILED DESCRIPTION OF THE INVENTION

The following detailed description describes the best currently contemplated modes of carrying out the invention. The description is not to be taken in a limiting sense, but is made merely for the purpose of illustrating the general principles of the invention, since the scope of the invention is best defined by the appended claims.

Various inventive features are described below and each can be used independently of one another or in combination with other features. However, any single inventive feature may not address any or all of the problems discussed above or may only address one of the problems discussed above. Further, one or more of the problems discussed above may not be fully addressed by any of the features described below.

Figure 1:
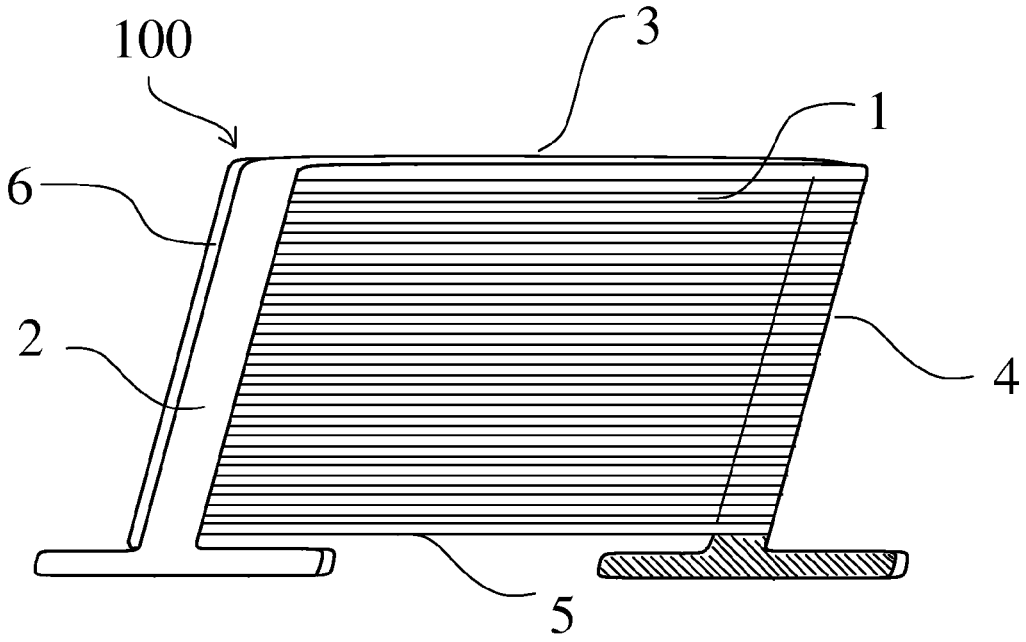
FIG. 1 shows a perspective view of the golf ball catching apparatus in accordance with an exemplary embodiment of the present invention.

FIG. 1 of the accompanying drawings shows a simplified perspective view of a golf ball catching apparatus 100 in accordance with an exemplary embodiment of the present invention. More specifically, FIG. 1 shows a golf ball catching apparatus 100 having a first energy absorbing layer across the frontal portion of the golf ball catching apparatus 100. The first energy absorbing layer 1 is secured to the golf ball catching apparatus 100 via a frame, wherein the frame is created by a first side frame 2, a second side frame 4, a top frame 3, and a bottom frame 5, combining to create a rigid structure for which the first energy absorbing layer 1 can be secured to. In this current exemplary embodiment, the first energy absorbing layer 1 is created from a plurality of strands spanning horizontally across the frontal portion of the golf ball catching apparatus 100 in order to catch a golf ball, however, the plurality of strands of the first energy absorbing layer 1 can span vertically, diagonally, or in any angle, degree, or orientation relative to the frame all without departing from the scope and content of the present invention so long as the orientation selected is capable of catching a golf ball.

The first energy absorbing layer 1 shown here, irrespective of the orientation of the strands, is placed at a frontal portion of the golf ball catching apparatus 100, and serves to absorb and dissipate at least a portion of the energy within the golf ball as it contacts the golf ball catching apparatus 100. In the current exemplary embodiment of the present invention, the first energy absorbing layer 1 created by a plurality of strands is generally paired with a second energy absorbing layer 6 located behind the first energy absorbing layer 1 to further absorb and dissipate some of the remaining amount of energy inherent within a golf ball as it contacts the golf ball catching apparatus 100. Here in FIG. 1, only a corner of the second energy absorbing layer 6 is shown, but in reality it spans across the entire rear portion of the ball catching apparatus 100, and its visibility is only concealed in this view due to the placement of the first energy absorbing layer 1 at the frontal portion of the golf ball catching apparatus 100.

Second energy absorbing layer 6, as contemplated in by the current invention, may generally serve the purpose of absorbing the remainder of the energy left within the golf ball, after it has contacted and often penetrated the first energy absorbing layer 1. The second energy absorbing layer 6, as shown in FIG. 1 could also be defined as a backing layer due to it's physical placement within the golf ball catching apparatus 100, and is generally comprised out of a strong thick fabric material such a nylon; but could also be comprised of sponge, foam, carpet, any type of tough fabric, or any other type of material capable of absorbing and dissipating the energy of a golf ball all without departing from the scope and content of the present invention. In an alternative embodiment of the present invention, the second energy absorbing layer 6 could be comprised of a material similar to wall padding, as wall padding is generally comprised of a thin wafer board base on to which padding foam is bonded and then covered with thin fabric. In a further alternative embodiment of the present invention the second energy absorbing layer 6 could also be comprised out of mats similar to those used for cheerleading, wresting, and karate, as these mats are generally comprised of polyethylese closed cell, cross linked, polyethylene foam, all of which promotes energy absorption.

Because there is a plethora of materials that could be used for the second energy absorbing layer 6, it is worthwhile to note here that the second energy absorbing layer 6 differs from the first energy absorbing layer 1 in another very significant way in that the material used may generally have a greater density. However, due to the fact that the backing material may sometimes be made out of a compressible material, the density of the material here may be more accurately represented in terms of the mass of the material as projected over a specific area. More specifically, the second energy absorbing layer 6 may generally have a mass of greater than about 1.2 kg over a projected area of 1 meter squared, more preferably greater than about 1.4 kg over a projected area of 1 meter squared, and most preferably greater than 1.6 kg over a projected area of 1 meter squared. The first energy absorbing layer 1, on the other hand, may generally have a mass of less than about 1.0 kg over a projected area of 1 meter squared, more preferably less than about 0.8 kg over a projected area of 1 meter squared, and most preferably less than about 0.7 kg over a projected area of 1 meter squared.

Based off the relative mass of the different layers described above, a valuable relationship can be gleamed. More specifically, a relative mass ratio between the two layers can be established over the same projected area. The Relative Mass Ratio is important to the present invention in that it helps describe the relationship between the two layers, and can be defined by Equation (1) below:

$$\text{Relative Mass Ratio} = \frac{\text{Mass of Second Energy Absorbing Layer over square meter}}{\text{Mass of First Energy Absorbing Layer over square meter}} \quad \text{Eq. (1)}$$

The Relative Mass Ratio of the golf ball catching apparatus 100 in accordance with the present invention may generally be greater than about 1.2, more preferably greater than about 1.75, and most preferably greater than about 2.00.

Before moving onto a discussion regarding the frame of the present invention, it is worth identifying an additional relationship between the first energy absorbing layer 1 and the second energy absorbing layer 6; as these two components are essential to the proper functionality of the present invention. More specifically, the first energy absorbing layer 1, being placed at a frontal portion of the golf ball catching apparatus 100, serves as the initial source of energy absorption and dissipation. However, due to the fact that the first energy absorbing layer is being comprised out of a plurality of strands, it intentionally lets the golf ball pass through the first energy absorbing layer 1 to reach the second energy absorbing layer 6. The second energy absorbing layer 6, being placed at the rear portion of the golf ball catching apparatus 100, serves to absorb a significant portion of the remainder of the energy still left with the golf ball after passing through the first energy absorbing layer 1. Because the second energy absorbing layer 6 serves to absorb the majority of the energy of a golf ball, it can be said that the second energy absorbing layer 6 absorbs more energy than the first energy absorbing layer 1. Alternatively speaking a "energy absorption ratio" of the second energy absorbing layer 6 is greater than a "energy absorption ratio" of the first energy absorbing layer 1; with the "energy absorption ratio" defined as a function of the velocity of the golf ball before and after it contacts the energy absorbing layer shown by Equation (2) below:

$$\text{Energy Absorption Ratio} = \frac{\text{Velocity of object before impacting layer}}{\text{Velocity of object after impacting layer}} \quad \text{Eq. (2)}$$

Finally, it can also be said that the first energy absorbing layer 1 has a first energy absorption ratio (R1) that is lower than the second energy absorption ratio (R2) of the second energy absorbing layer 6.

For example, in one embodiment of the present invention, the velocity of a golf ball before impacting the first layer will be approximately 70 mph, and it will be approximately 60 mph after passing through the first energy absorbing layer 1; yielding a first energy absorption ratio (R1) of about 1.16. At the same time, a golf ball before impacting the second energy absorbing layer will have a velocity of approximately 60 mph and a velocity of approximately 25 mph after impacting the second energy absorbing layer 6; yielding a second energy absorption ratio (R2) of 2.4.

The frame of the golf ball catching apparatus 100, including the first side frame 2, the second side frame 4, the top side frame 3, and the bottom side frame 5 may generally be formed of any rigid material, as the rigidity of the material provides the golf ball catching apparatus 100 with structural rigidity. In one exemplary embodiment the frame may be composed of a steel type material for its high rigidity content, however, in other embodiments the frame could be made out of aluminum, titanium, iron, lead, carbon fiber, or any other type of material capable of forming a rigid frame all without departing from the scope and content of the present invention. In fact, in an alternative embodiment of the present invention, various portions of frame need not be made out of the same material, and could be adjusted for various performance properties also without departing from the scope and content of the present invention.

The rigidity of the frame is important to the proper function of the current golf ball catching apparatus because it provides a basis from which the first energy absorbing layer 1 can be stretched against to create the tension required within the individual strands. The tension of the individual strands within the first energy absorbing layer 1 is an essential component to the proper functionality of the present invention because it provides the plurality of strands the necessary boundary to create tension within the plurality of strands. The tension within the plurality of strands is important to the first energy absorbing layer 1 because it controls the amount of energy absorbed, and this amount of energy absorption can be adjusted by changing the tension of the plurality of strands.

Finally, it should be noted here that in this current exemplary embodiment of the present invention the first side frame 2, the second side frame 4, the top frame 3, and the bottom frame 5 all work in conjunction to connect the first energy absorbing layer 1 and the second energy absorbing layer 6 to provide structural rigidity to the second energy absorbing layer 6 in addition to the first energy absorbing layer 1. The providing of the structural integrity to the first energy absorbing layer 1 is critical to the proper functionality of the present invention, as previously discussed. However, with respect to providing structural rigidity to the second energy absorbing layer 6, it should be noted that the mat material generally used may already have some inherent structural rigidity, but the frame will further enhance the structural rigidity of the second energy absorbing layer 6 without departing from the scope and content of the present invention. Thus, in this current exemplary embodiment of the present invention, the first side frame 2, the second side frame 4, the top frame 3, and the bottom frame 5 all work in conjunction to connect the first energy absorbing layer 1 and the second energy absorbing layer 6 via a perimeter of the golf ball catching apparatus 100.

Figure 2A:
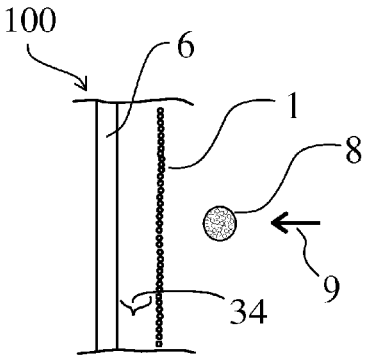
FIGS. 2A-2F shows a chronological progression of the golf ball as it impacts the golf ball catching apparatus.

FIGS. 2A, 2B, 2C, 2D, 2E, and 2F all shows a simplified side view of the golf ball catching apparatus 100, illustrating how the golf ball catching apparatus 100 functions during its operation. FIG. 2A shows a golf ball 8 is seen approaching the golf ball catching apparatus 100 traveling in a direction indicated by arrow 9. It can be seen from FIG. 2A, the first energy absorbing layer 1 is placed at a frontal portion of the golf ball catching apparatus 100 while the second energy absorbing layer 6 is placed at a rear portion of the golf ball catching apparatus 100. The first energy absorbing layer 1 and the second energy absorbing layer 6 is separated by a gap 34, the importance of which will be shown in more detail later.

Figure 2B:
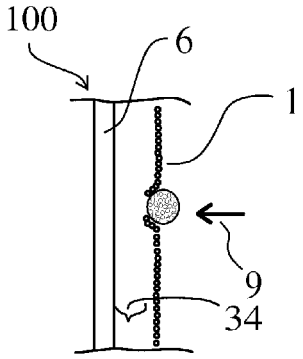
Figure 2C:
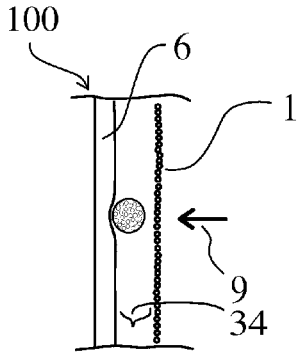

FIG. 2B shows the golf ball 8 as it impacts the first energy absorbing layer 1. This simplified side view of the invention illustrates that due to the fact that the first energy absorbing layer 1 is comprised of a plurality of strands, those strands can shift and provide some elasticity to allow the golf ball 8 to travel through and penetrate the first energy absorbing layer 1. Notice in FIG. 2B, the arrow indicating the direction of travel of the golf ball 8 is still pointed into the golf ball catching apparatus 100, meaning the energy of the golf ball 8 has not been completely absorbed. FIG. 2C shows the next phenomenon that occurs once the golf ball 8 has completely penetrated the first energy absorbing layer 1. More specifically FIG. 2C shows the golf ball 8 impacting the second energy absorbing layer 6, creating a slight deformation in shape of the second energy absorbing layer 6, which is responsible for the further absorption of the energy inherent within the golf ball 8.

Figure 2D:
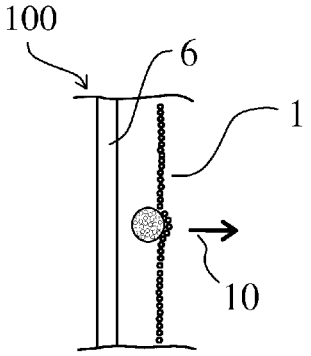

Once the golf ball 8 has rebounded off the second energy absorbing layer 6, it begins traveling in the reverse direction to impact an internal surface of the first energy absorbing layer 1, as illustrated by FIG. 2D. This new direction of the golf ball 8 is once again shown by arrow 9, and it can be seen from FIG. 2D that it is pointed at a direction that is opposite of the previous arrows. It is worth noting here that the first energy absorbing layer 1 now serves an additional purpose of slowing down and absorbing the energy of the rebounded golf ball 8 from exiting the golf ball catching apparatus 100. The ability of the first energy absorbing layer 1 to work in conjunction with the second energy absorbing layer 6 to prevent the golf ball 8 from exiting the golf ball catching apparatus 100 is just as important if not more important than the initial ability of the first energy absorbing layer 1 to absorb and reduce the initial impact energy of a golf ball 8 because it prevents the golf ball 8 from popping out of the golf ball catching apparatus 100 to potentially strike a golfer.

Based on the above requirement, it can be seen that determining the proper tension within the plurality of strands is incredibly critical. Having the tension too high creates a problem in that it will not allow the golf ball to penetrate the first energy absorbing layer 1 and could potentially bounce right back at the golfer itself. Having the tension set too low creates a completely different problem in that it will not have sufficient ability to prevent a golf ball 8 from rebounding and striking the golfer itself. Alternatively speaking, it is important that the tension within the plurality of strands used to form the first energy absorbing layer 1 should allow a golf ball traveling at greater than velocity X to pass through the first energy absorbing layer 1, but prevents the same golf ball traveling at less than velocity X from passing through the same first energy absorbing layer 1 when rebounding off the second energy absorbing layer 6.

Figure 2E:
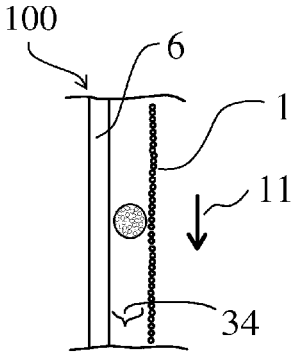
Figure 2F:
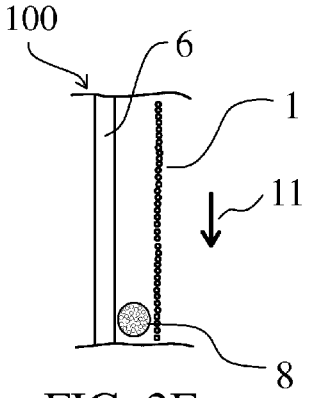

FIG. 2E shows what happens to the golf ball 8 once all of the energy stored within it has been absorbed by either the first energy absorbing layer 1 and or the second energy absorbing layer 6. More specifically, FIG. 2E shows the golf ball 8 falling down within the gap 34 in a direction indicated by directional arrow 9. Gap 34, as shown in this current exemplary embodiment, may generally be slightly less than the diameter of the golf ball 8 of 1.680 inches to allow the golf ball 8 to ripple the strands of the first energy absorbing layer 1 as it falls down, creating a visual feedback often desired by golfers. However, it should be noted that the distance of the gap 34 could be greater than 1.680 inches to create an invisible golf ball 8 return effect or even significantly less than 1.680 inches to retain the a golf ball 8 at the impact location all without departing from the scope and content of the present invention. Finally, FIG. 2F shows the golf ball 8 near the bottom of its descent within the gap 34.

Figure 3A:
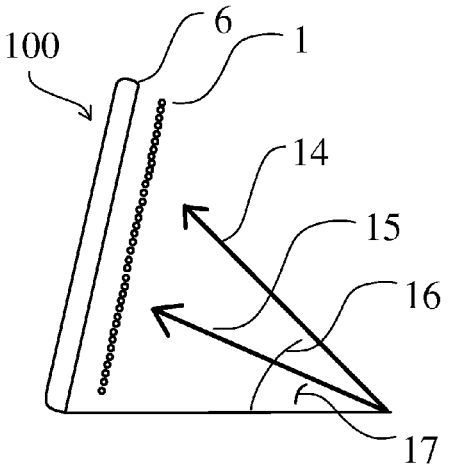
FIG. 3A shows a side view of the golf ball catching apparatus in accordance with an exemplary embodiment of the present invention.
Figure 3B:
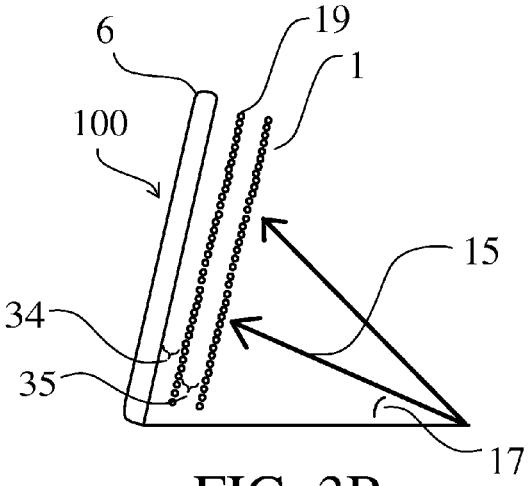
FIG. 3B shows a side view of the golf ball catching apparatus in accordance with an alternative embodiment of the present invention.
Figure 3C:
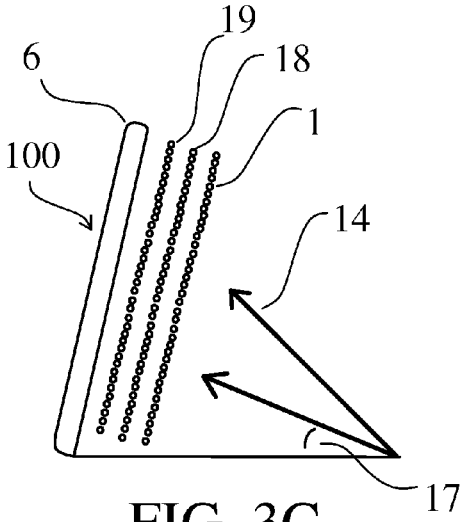
FIG. 3C shows a side view of the golf ball catching apparatus in accordance with a further alternative embodiment of the present invention.

FIGS. 3A, 3B, and 3C show simplified side views of a golf ball catching apparatus 100 in accordance with different alternative embodiments of the present invention together with different arrows depicting different launch angles of golf balls. More specifically, FIG. 3A shows two different launch angles depicting different scenarios that could be created when using different types of golf clubs. In one example arrow 14 depicts a high launching scenario similar to that of a golf ball being struck by a pitching wedge type golf club with a higher launch angle 16 of about 35 degrees. In an alternative example, arrow 15 depicts a low launching scenario similar to that of a golf ball being struck by a 7 iron type golf club with a lower launch angle 17 of about 25 degrees. The importance of FIG. 3A shows that the current golf ball catching apparatus 100 is capable of accommodating different types of golf shots with different types of golf clubs, and could even be expanded in size and tilt angle to accommodate even higher launching golf balls that could result from higher lofted clubs all without departing from the scope and content of the present invention.

FIG. 3B shows a golf ball catching apparatus 100 in accordance with an alternative embodiment of the present invention wherein an intermediary energy absorbing layer 19 is placed between the first energy absorbing layer 1 and the second energy absorbing layer 6. The intermediary energy absorbing layer 19, in this current exemplary embodiment of the present invention, may generally have identical physical and performance characteristics as the first energy absorbing layer 1 to create a triple energy absorbing layer setup. However, in a different embodiment of the present invention, the intermediary energy absorbing layer 19 may have completely different stand tensions, strand orientations, or even strand material to create an entirely different golf ball catching apparatus all without departing from the scope and content of the present invention. Finally, FIG. 3B also shows different gap distances 34 and 35 to separate the intermediary energy absorbing layer 19 and the second energy absorbing layer 6 and the first energy absorbing layer 1 respectively. The width of these gaps 34 and 35 could be similar to one another according to the discussion of gap 34 earlier, however, the distance of these gaps 34 and 35 could be completely different from one another to achieve a different reaction between the golf ball and the golf ball catching apparatus without departing from the scope and content of the present invention.

FIG. 3C shows a golf ball catching apparatus 100 in accordance with a further alternative embodiment of the present invention wherein two intermediary energy absorbing layers 18 and 19 are placed between the first energy absorbing layer 1 and the second energy absorbing layer 6. Similar to the discussion above, the specific performance criteria of the intermediary energy absorbing layers 18 and 19 could also be adjusted to achieve an entirely different result without departing from the scope and content of the present invention.

Figure 4A:
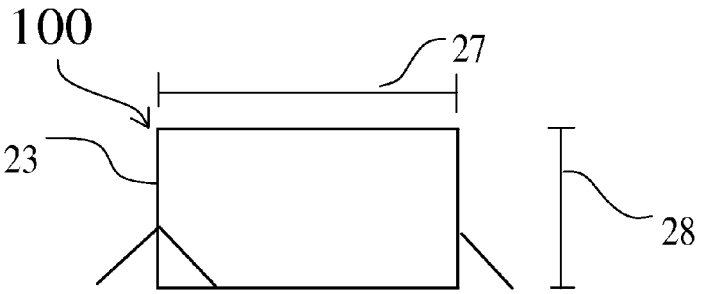
FIG. 4A-4D shows schematic perspective views of additional setup configurations in accordance with different embodiment of the present invention.
Figure 4B:
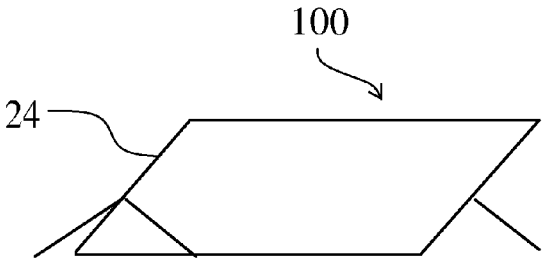
Figure 4C:
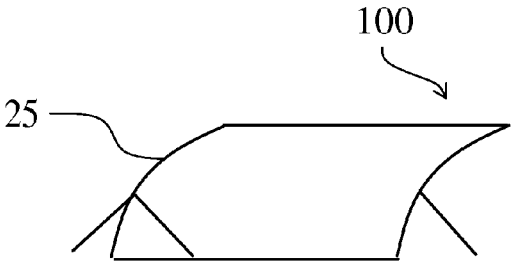
Figure 4D:
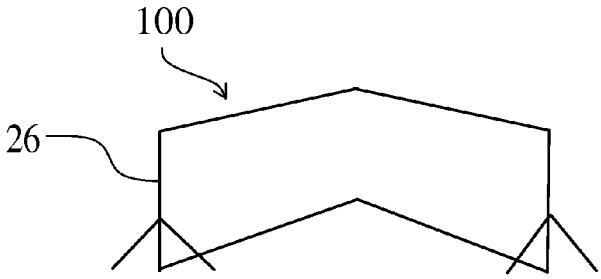

FIG. 4A through 4C show various shapes and sizes of a golf ball catching apparatus 100 in accordance with different embodiments of the present invention. More specifically, FIG. 4A shows the golf ball catching apparatus 100 having a rectangular shape with a width 27 and a height 28, and this embodiment could be mounted directly onto a wall without departing from the scope and content of the present invention. FIG. 4B shows an embodiment wherein the golf ball catching apparatus 100 can be leaned in at an angle towards the resting golf ball, as this embodiment could improve the efficiency of the golf ball capture. FIG. 4C shows a further alternative embodiment of the present invention wherein the top of the golf ball catching apparatus 100 could have a concave curvature 25, as this curvature can help capture a golf ball launched at an extremely high launch angle. Finally, FIG. 4D shows a further alternative embodiment of the present invention wherein the golf ball catching apparatus 100 has a side wall, capable of capturing errant golf balls launched in an angled direction.

Figure 5A:
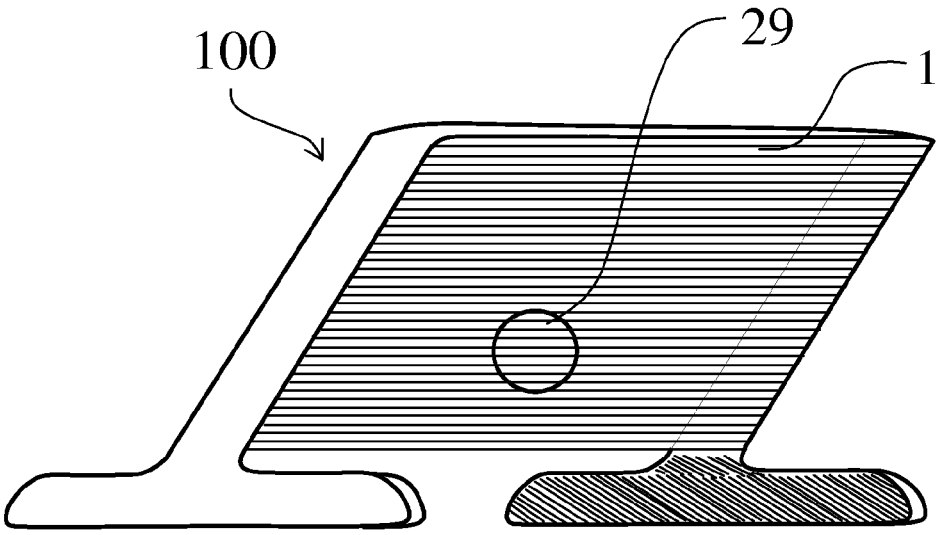
FIG. 5A shows a perspective view of the golf ball catching apparatus with an actual golf ball.
Figure 5B:
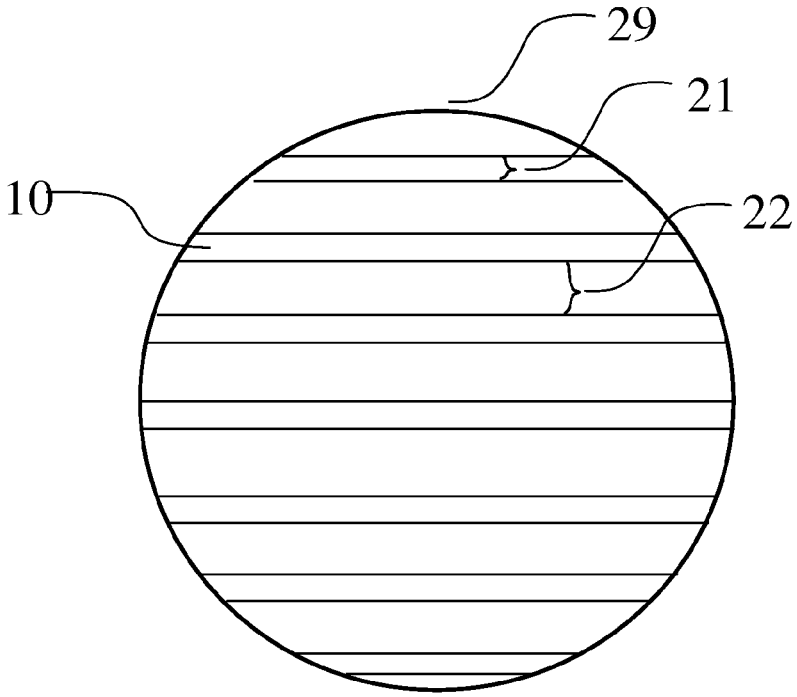
FIG. 5B shows an enlarged view of a portion of the cord as depicted by circular portion 29.

Because the strands of the first energy absorbing layer 1 are so crucial to the operation of the current golf ball catching apparatus 100, FIGS. 5A and 5B focuses on the importance of the strands 10 by highlighting them within the golf ball catching apparatus 100. More specifically, FIG. 5A shows a simplified frontal perspective view of the golf ball catching apparatus 100 highlighting a circle 29, from which an enlarged view of the circular location 29 is provided in FIG. 5B. The enlarged view of the plurality of strands 10 of the first energy absorbing layer 1 shown in FIG. 5B shows the plurality of strands 10 having a diameter 21 being separated by gaps 22. The plurality of strands 10, as shown in this current exemplary embodiment of the present invention, may generally be made out of slender and flexible material and can even be comprised of several strands being twisted together all without departing from the scope and content of the present invention. The diameter 21 of the strands is generally consistent within the entire first energy absorbing layer 1, but could be altered and varied throughout the first energy absorbing layer 1 as well if a different performance criterion is desired at different parts of the first energy absorbing layer 1. The plurality of strands 10 can be string-like pieces of relatively rigid or flexible metal or other materials and can be manufactured in a variety of diameters. The plurality of strands 10 can be narrow strip of flexible material. The plurality of strands 10 can be thin length of cord, twine, fiber, or similar material used for tying, hanging, binding, or the likes all without departing from the scope and content of the present invention. It should be noted here that the coefficient of friction of the external surface of the plurality of strands 10 could also affect the performance of the first energy absorbing layer, as higher coefficient of friction would slow the golf ball more during impact, and vice versa. Finally the distance of the gaps 22 between the plurality of strands 10 can be adjusted as necessary to provide optimal catching of a golf ball.

The diameter 21 of the plurality of strands 10, in one exemplary embodiment of the present invention, may generally be between about 0.5 mm to about 3.0 mm, more preferably between about 1.0 mm to about 2.5 mm, and most preferably about 1.75 mm. Needless to say, the actual diameter of the strands can be adjusted even further by adjusting the tension of the plurality of strands 10, the material of the plurality of stands 10, or even the composition of the plurality of strands 10. Thinner strands 10 having a smaller diameter 21 may generally be less durable when compared to thicker strands.

The plurality of strands 10 can have different construction in different embodiments of the present invention. In one exemplary embodiment of the present invention the plurality of strands 10 could have a solid core with an outer wrap, while in an alternative embodiment of the invention, the plurality of strands 10 could have a solid core with multiple wraps. In an alternative embodiment of the present invention the plurality of strands 10 can be comprised of a multifilament without departing from the scope and content of the present invention. In an even further alternative embodiment of the present invention a combination of different materials can be blended together to achieve the requisite performance criteria for the plurality of strands 10 within the scope of the present invention. More specifically, the materials that can be used to create the plurality of strands 10 can be nylon, polyester, polypropylene, polyethylene, cotton, gut, steel, Kevlar®, or any other material capable of creating such a tension within the strands 10.

Not only is the material used to create the plurality of strands 10 important to the proper functionality of the first energy absorbing layer 1, the amount of tension on the plurality of strands 10 are just as important. More specifically, the tension in the plurality of strands 10, combined with the material used to create the plurality of strands 10 needs to be able to be elastic enough to allow the golf ball to pass through the first energy absorbing layer 1 upon initial impact as shown in FIG. 2B above, but be stiff enough to prevent the golf ball from re-penetrating the first energy absorbing layer 1 upon rebound off a backing layer 6 as shown in FIG. 2D. Alternatively speaking, the plurality of strands 10 must be able to allow a golf ball having greater than a first prescribed velocity to pass through the first energy absorbing layer 1 but also be able to stop the same golf ball from re-penetrating the first energy absorbing layer 1 if that golf ball is traveling at a velocity lower than a second prescribed velocity. In one exemplary embodiment of the present invention the prescribe tension is between about 10 $lb_f$ (pound-force) and 40 $lb_f$, more preferably between about 15 $lb_f$ and 35 $lb_f$, and most preferably between about 20 $lb_f$ and 30 $lb_f$. (using the same definition of tension as in tennis racquet)

In one exemplary embodiment of the present invention, the plurality of strands 10 may be comprised out of multiple individual and separate strands 10, each individually anchored to create its individual tension setting. However, in an alternative embodiment of the present invention, the plurality of strands 10 can be created using a unitary piece of strand similar to that of a tennis racquet, without departing from the scope and content of the present invention.

Finally, it should be noted that similar to a tennis racquet, various sound attenuation devices may also be added to the plurality of strands 10 at various points of the first energy absorbing layer 1 to adjust the sound of the golf ball catching apparatus 100 without departing from the scope and content of the present invention. The sound of the first energy absorbing layer 1 could also be adjusted by altering the strand 10 material, the strand 10 thickness, strand 10 tension, or any other factors.

Figure 6A:
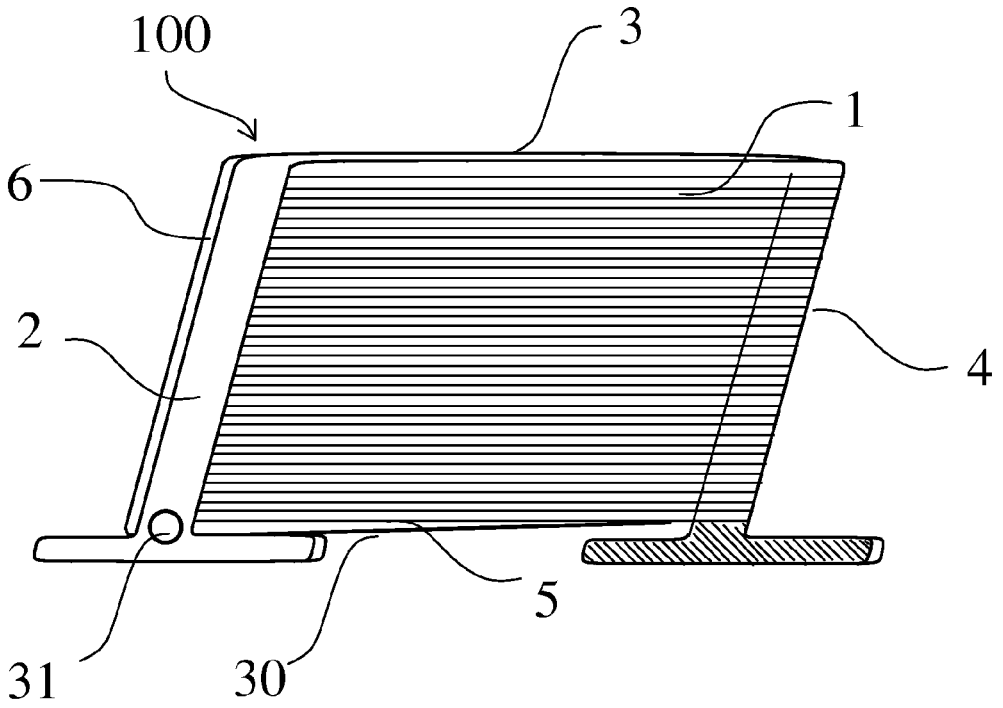
FIG. 6A shows a frontal view of the golf ball catching apparatus in according with a further alternative embodiment of the present invention illustrating a location of the golf ball exit.
Figure 6B:
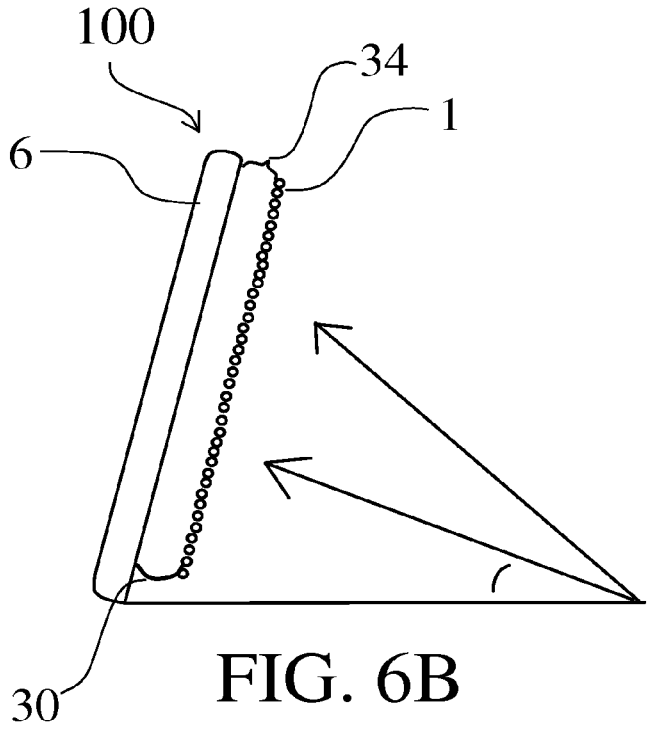
FIG. 6B shows a side view of the golf ball catching apparatus in accordance with a further alternative embodiment of the present invention illustrating a location of the golf ball exit.

FIGS. 6A and 6B shows a golf ball catching apparatus 100 in accordance with a further alternative embodiment of the present invention. More specifically, FIG. 6A shows a frontal perspective view of the golf ball catching apparatus 100 with a gutter 30 near the bottom of the golf ball catching apparatus 100 to capture a golf ball and return it back to the golfer via a drainage hole 31. FIG. 6B shows a side view of the golf ball catching apparatus 100 to show the gutter 30 being places at the bottom of the golf ball catching apparatus 100 between the first energy absorbing layer 1 and the second energy absorbing layer 6.

Figure 7:
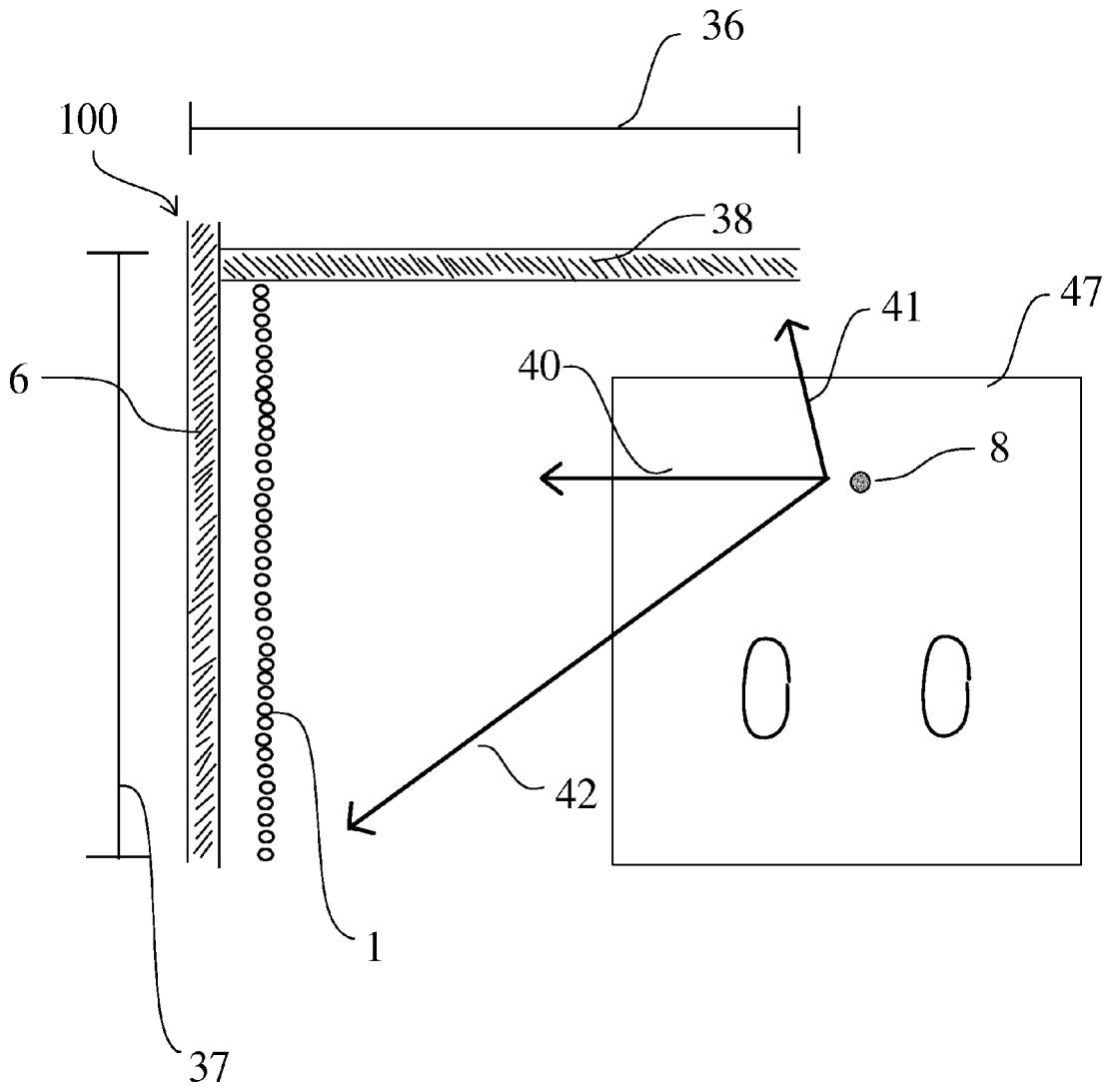
FIG. 7 shows a schematic top view of the golf ball catching apparatus as it would be used by a golfer.

FIG. 7 shows a top view of the golf ball catching apparatus 100 in accordance with an alternative embodiment of the present invention showing how the golf ball catching apparatus 100 would be used in practice with a golfer. In this alternative embodiment of the present invention, golf ball catching apparatus 100 may have an additional side layer 38 constructed out of a similar material as the backing layer 6 to deflect and minimize the harsh effects of a missed golf shot. In this current exemplary embodiment of the present invention, the side layer 38 may have a length 36 of approximately 5 feet, similar to the length 37 of the backing layer 6, which is also approximately 5 feet. It should be noted here that the current setup is arranged for a right handed golfer, as the most prevalent miss for a golfer is a shank; however, the setup could be reversed to place the side layer 38 on the other side to prevent a hook, or even to setup for a left handed golfer without departing from the scope and content of the present invention.

FIG. 7 also shows a mat 47 placed relatively close to side layer 38. Arrows 40, 41, and 42 demonstrate potential paths of golf ball 8 from a top view. A severe shank is illustrated by arrow 41, which indicates a shank shot of about 80 degrees to the right of straight shot 40. A golf shot that hits side layer 38 will likely bounce off side layer 38, hit the first energy absorbing layer 1 and be trapped by the golf ball catching apparatus 100. It should be noted that the side layer 38 need not provide as much energy absorption, as a severe shank will most likely not have as much speed.

Figure 8:
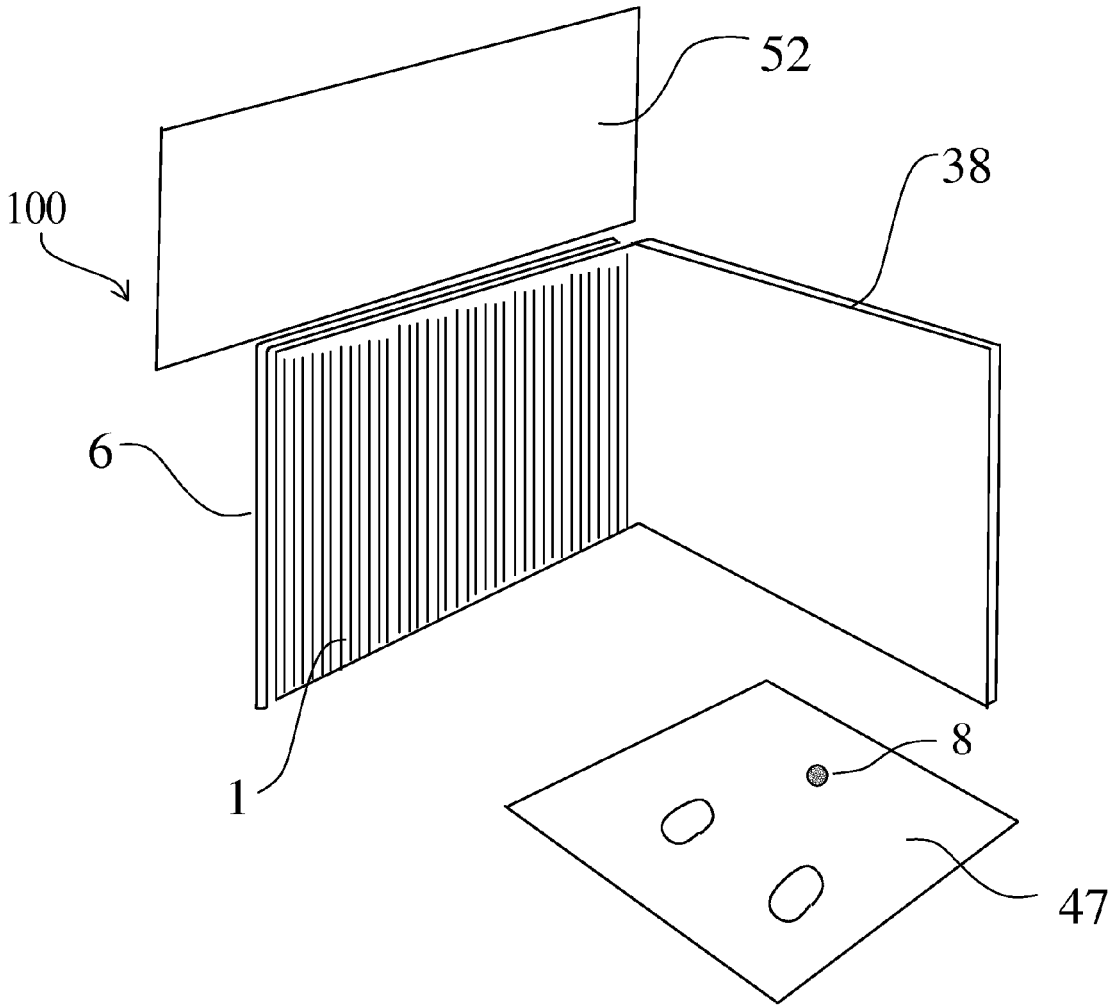
FIG. 8 shows a schematic perspective view of the golf ball catching apparatus as it would be used by a golfer.

FIG. 8 shows a three dimensional perspective view of a golf ball catching apparatus 100 in accordance with a further alternative embodiment of the present invention wherein a display 52 is included to provide some visual feedback to the golfer regarding his golf shot. The visual feedback shown by the display 52, as shown in this current exemplary embodiment of the present invention, may include the golf ball data, golf swing data, and could even display a simulation of a golf shot all without departing from the scope and content of the present invention. In addition to the display, the golf ball catching apparatus 100 shown in FIG. 8 may also incorporate a video camera to capture the golfer's swing. This video capture of the golfer's swing could then be used to help the golfer analyze his golf swing as well.

Figure 9:
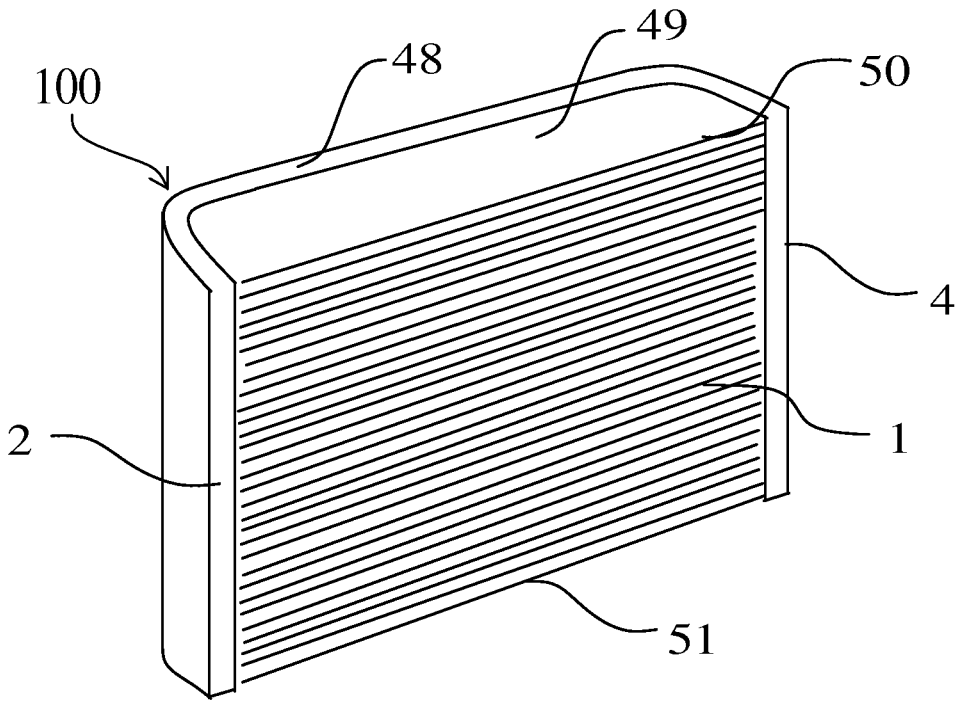
FIG. 9 shows a perspective view of the golf ball catching apparatus in accordance with a further alternative embodiment of the present invention.

FIG. 9 shows a golf ball catching apparatus 100 in accordance with a further alternative embodiment of the present invention wherein the overall shape is altered. In this exemplary embodiment, the top frame and the bottom frame is removed to prevent an accidental impact with the frames that could ricochet and injure the golfer. The golf ball catching apparatus 100 shown in FIG. 9 replaces the top and bottom frames with a top support 48 and a bottom support that is recessed into the internal portion of the golf ball catching apparatus 100 to provide greater safety. Finally, FIG. 9 also shows a space 49 behind the top support 48 where the second energy absorbing layer could be incorporated.

Figure 10A:
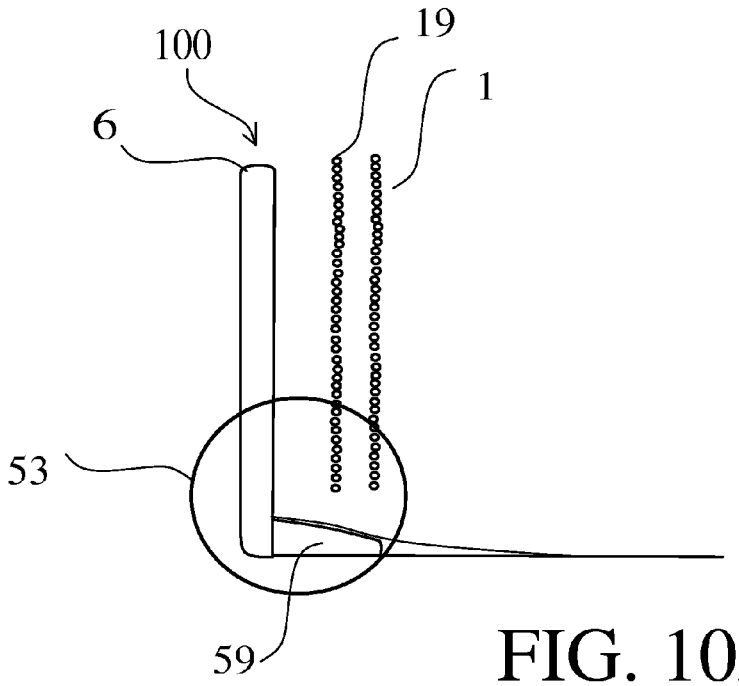
FIG. 10A shows a side view of the golf ball catching apparatus in accordance with an even further alternative embodiment of the present invention.
Figure 10B:
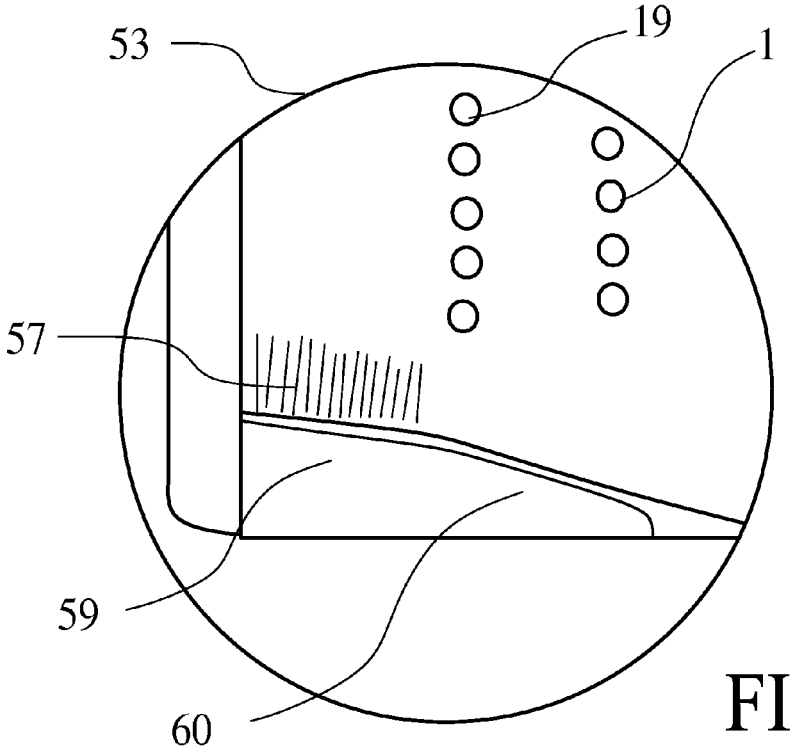
FIG. 10B shows an enlarged view of circular region 53 as shown in FIG. 10A.

FIG. 10A shows a side view of a golf ball catching apparatus 100 in accordance with a further alternative embodiment of the present invention wherein a ramp 59 is added to the bottom of the first energy absorbing layer 1 and the second energy absorbing layer 6 to provide a golf ball returning function. More specifically, the ramp 59 is placed at an incline, and the incline will utilize gravity to return the golf ball to the golfer after it has been struck into the golf ball catching apparatus 100. Finally, FIG. 10B shows an enlarged side view of the ramp 59 portion of the golf ball catching apparatus 100 identified by circle 53. The enlarged view of the ramp 59 illustrates an additional feature of the current embodiment wherein some artificial turf 57 could be added to provide additional impact absorption within the ramp 59. It should be noted that the portion of artificial turf 57 is only placed at the portion that is directly in front of the second energy absorbing portion 6, as this portion of the golf ball catching apparatus 100 does not slow down the rate of drop of the golf ball. However, if additional intermediary energy absorbing layers 19 are added to the ball catching apparatus, that frontal portion 60 of the ramp 59 would not necessarily require any artificial turf 57 to absorb the impact of the ball drop, as the plurality of strands of the first energy absorbing layer 1 and the intermediary energy absorbing layer 19 will help absorb some of the speed of the golf ball as it is falling down.

Figure 11:
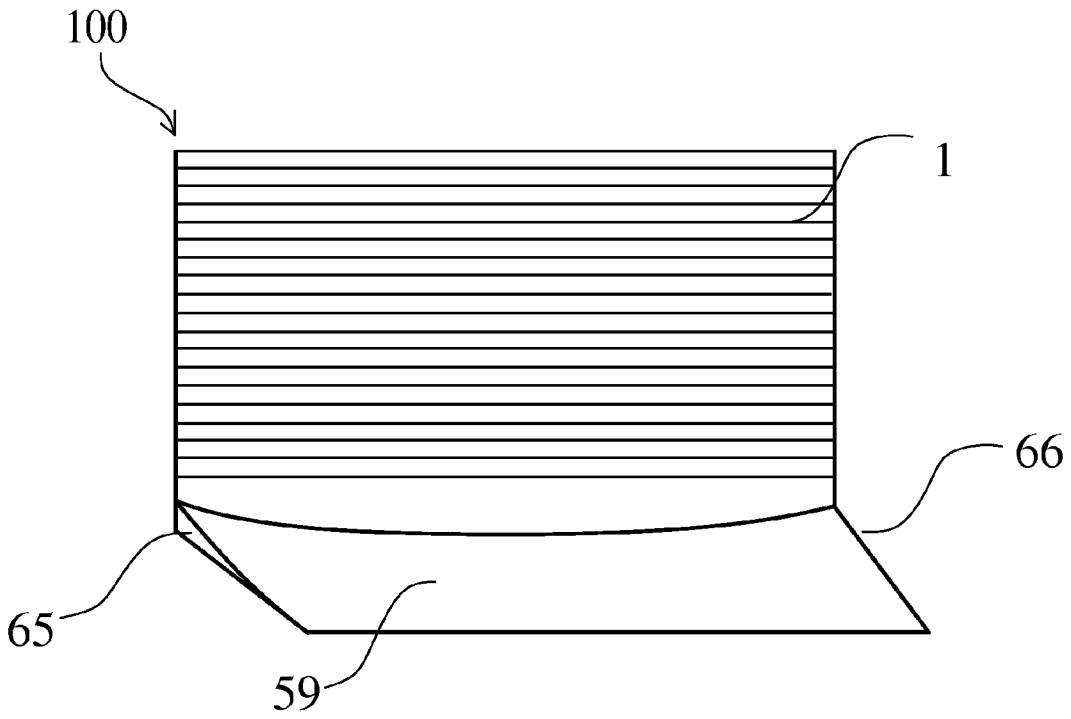
FIG. 11 shows a frontal perspective view of the golf ball catching apparatus illustrating various patterns of golf ball return.

FIG. 11 of the accompanying drawings shows a frontal perspective view of a golf ball catching apparatus 100 in accordance with a further alternative embodiment of the present invention. More specifically, in this alternative embodiment of the present invention the edges 65 and 66 of the ramp 59 may be elevated to provide even greater ball funneling effect towards the center of the golf ball catching apparatus 100. In this current exemplary embodiment of the present invention, the elevated edges 65 and 66 of the ramp 59 will help funnel a golf ball back to the center of the ramp 59 even if the golf ball is hit into the golf ball catching apparatus 100 a little off center.

In this alternative embodiment of the present invention, a backlight could be incorporated into the rear of the golf ball catching apparatus 100 to provide more visual feedback on the location of impact. How this alternative embodiment achieves this visual feedback is by taking advantage of the separation of the plurality of stands of the first energy absorbing layer. More specifically, as the plurality of strands separate, it will allow the backlight to be seen through that opening, creating the visual feedback that some golfers are looking for.

Figure 12A:
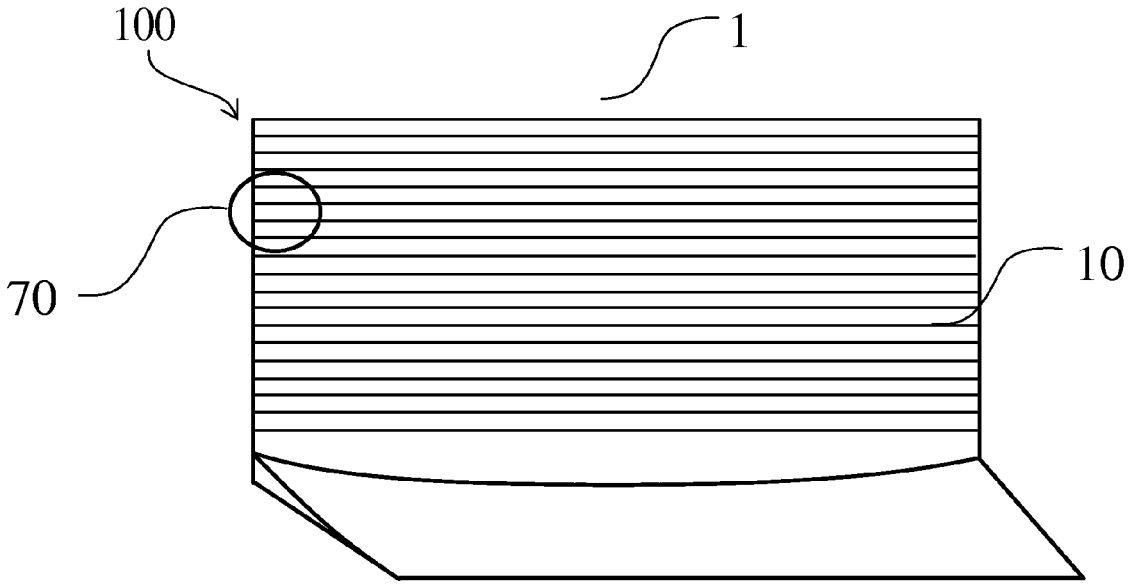
FIG. 12A shows a frontal perspective view of the golf ball catching apparatus in accordance with an even further alternative embodiment of the present invention.
Figure 12B:
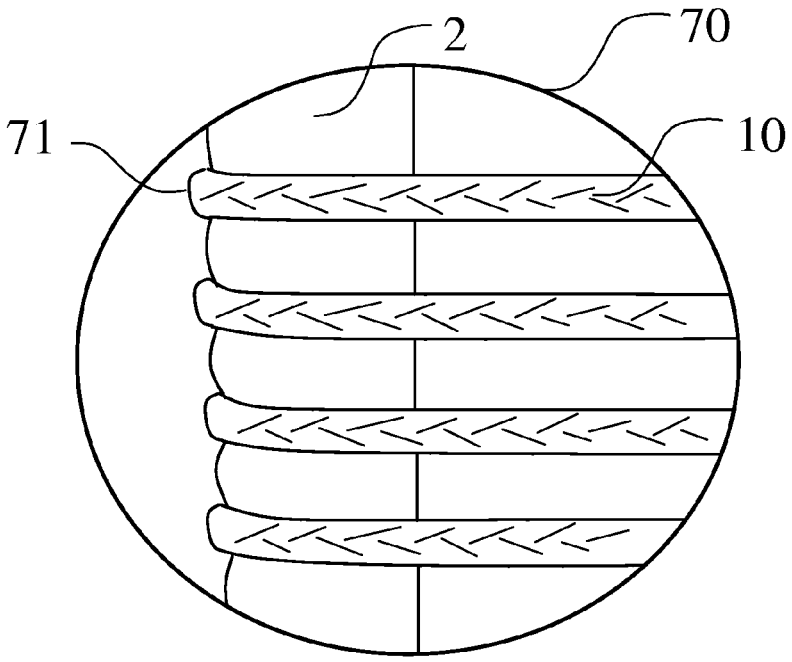
FIG. 12B shows an enlarged view of circular region 70 as shown in FIG. 12A

FIGS. 12A and 12B shows a golf ball catching apparatus 100 in accordance with a further alternative embodiment of the present invention. More specifically, in this exemplary embodiment of the present invention, the edges of the frame include slight indentations to prevent the strands 10 from shifting out of position. FIG. 12A provides an area 70 from which the left edge of the first energy absorbing layer 1 is enlarged in FIG. 12B. In FIG. 12B, the enlarged view of the first side frame 2 on the left side has a plurality of indentations 71 that allows the plurality of strands 10 to rest in, preventing any movement of the plurality of strands 10 when a golf ball penetrates the first energy absorbing layer 1 by splitting the strands 10. In this exemplary embodiment of the present invention, even if the plurality of strands 10 shift slightly when a golf ball penetrates the first energy absorbing layer, the plurality of indentations 71 will help nudge the strands 10 back to their original position.

FIGS. 13A through 13D shows further alternative embodiments of the present invention wherein an intermediary energy absorbing layer 19 is incorporated into the golf ball catching apparatus 100. Although a version of this embodiment having one or more intermediary energy absorbing layers 19 have been discussed before, these current figures illustrate an additional phenomenon that can occur when one or more intermediary energy absorbing layer 19 is present. More specifically, as it can be seen from FIG. 13A, a golf ball that is hit into the golf ball catching apparatus 100 can funnel down in one of three paths. The first potential path of a golf ball exiting the golf ball catching apparatus 100 is within the gap 34, occurring when the energy of the golf ball penetrates the first energy absorbing layer 1 and the intermediary energy absorbing layer 19 and bounces off the second energy absorbing layer 6 with insufficient amount of energy to re-penetrate the intermediary energy absorbing layer 19. The second potential path of a golf ball exiting the golf ball catching apparatus 100 is within gap 35, occurring when the energy of the golf ball is greater than described above to re-penetrate the intermediary energy absorbing layer 19 but not enough to re-penetrate the first energy absorbing layer 1. Finally, the third potential path of a golf ball to exit the golf ball catching apparatus 100 occurs when the golf ball has such high speed and energy, it penetrates both the intermediary energy absorbing layer 19 and the first energy absorbing layer 1 and pops out in front of the first energy absorbing layer 1.

When the golf ball exits the golf ball catching apparatus 100 within gap 35, between the first energy absorbing layer 1 and the intermediary energy absorbing layer 19, it creates a ripple effect as the drops down in the gap 35. This visual rippling effect can also be called a "waterfall effect", which is illustrated in more detail in FIG. 13B. In order to promote this visually stimulating "waterfall effect", the golf club catching apparatus 100 shown in FIG. 13A may have the top portion 76 of the second energy absorbing layer 6 angled and pointing closer to the golfer, as it has been determined that this is one method to improve the change of the golf ball to drop down within the gap 35.

Figure 13A:
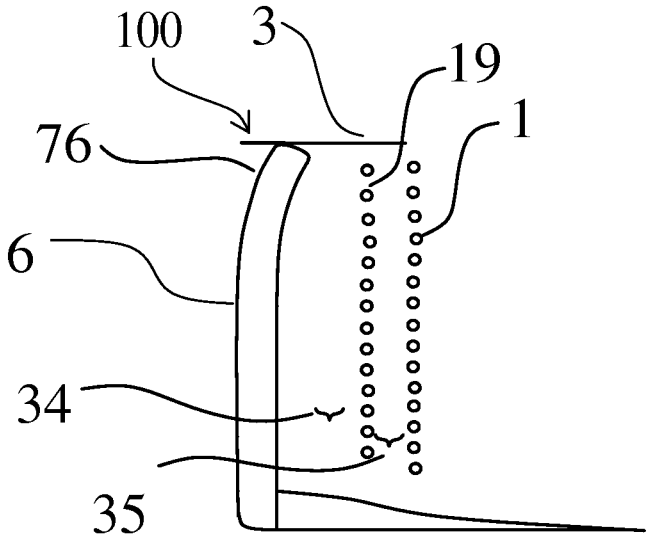
FIG. 13A shows a side view of the golf ball catching apparatus in accordance with an even further alternative embodiment of the present invention.
Figure 13B:
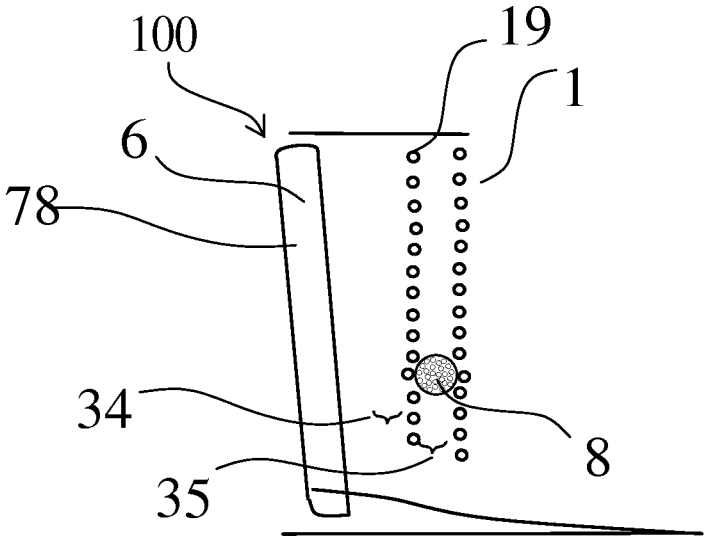
FIG. 13B shows a side view of the golf ball catching apparatus in accordance with an even further alternative embodiment of the present invention.

FIG. 13B of the accompanying drawings shows a side view of a golf ball 8 dropping down the gap 35, which as previously discussed, creates a visually desirable "waterfall effect". More specifically, as it can be seen in FIG. 13B, the golf ball 8 pushes the first energy absorbing layer 1 and the intermediate energy absorbing layer 19 away from one another as it falls down the gap 35 to create this "waterfall effect". This "waterfall effect" is created mainly because the distance of the gap 35 is generally less than the diameter of the golf ball 8, causing the different energy absorbing layers to ripple and push apart from one another as the golf ball 8 drops. In addition to illustrating this "waterfall effect", FIG. 13B also shows an alternative embodiment of the present invention, wherein the second energy absorbing layer 6 is angled away from the golfer. This specific embodiment has also been shown to increase the likelihood of generating the "waterfall effect".

Figure 13C:
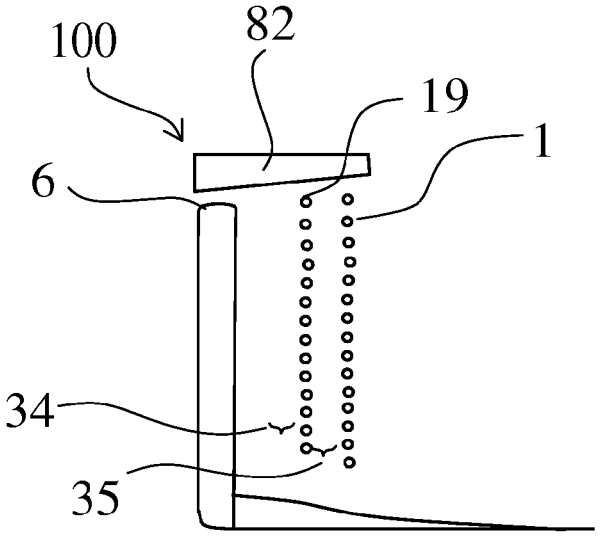
FIG. 13C shows a side view of the golf ball catching apparatus in accordance with an even further alternative embodiment of the present invention.

FIG. 13C shows a side view of a golf ball catching apparatus 100 in accordance with a further alternative embodiment of the present invention, wherein a ceiling portion 82 of the frame can have a light angle to help create the above mentioned "waterfall effect". More specifically, as illustrated in FIG. 13C, the angle in the ceiling portion 82 of the frame is angled away from the second energy absorbing layer 6, thus more likely to funnel a golf ball into the gap 35 when a golf ball gets launched upwards toward the ceiling portion 82 of the frame.

Figure 13D:
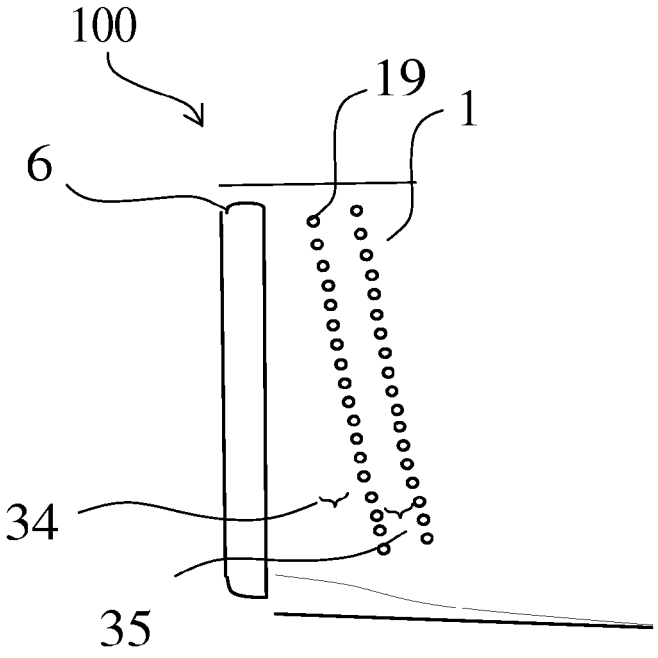
FIG. 13D shows a side view of the golf ball catching apparatus in accordance with an even further alternative embodiment of the present invention.

FIG. 13D shows a side view of a golf ball catching apparatus 100 in accordance with a further alternative embodiment of the present invention that promotes the "waterfall effect". More specifically, in this current exemplary embodiment, the second energy absorbing layer 6 may be vertical, but the first energy absorbing layer 1 and the intermediate energy absorbing layer 19 may be angled away from the energy absorbing layer 6. This angle of the first and intermediate energy absorbing layer 1 and 19 respectively could also work in combination with an adjustment in the tension of the strands of the layers to further promote the occurrence of the "waterfall effect".

Figure 14A:
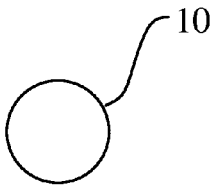
FIG. 14A-14I shows different cross-sectional views illustrating the different shapes of different stands that can be used to create the energy absorbing layer.
Figure 14B:
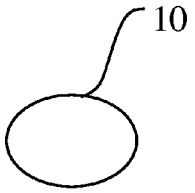
Figure 14C:
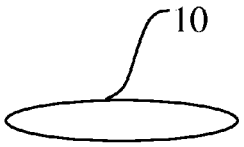
Figure 14D:
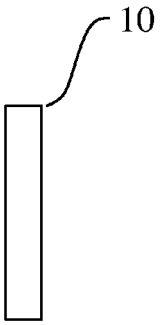
Figure 14E:
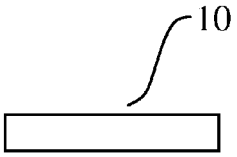
Figure 14F:
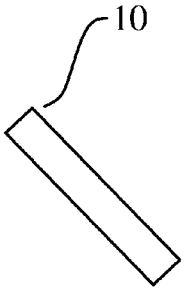
Figure 14G:
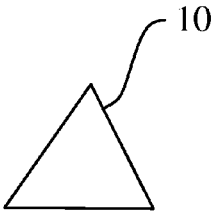
Figure 14H:
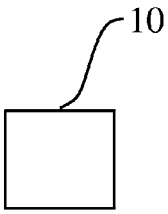
Figure 14I:
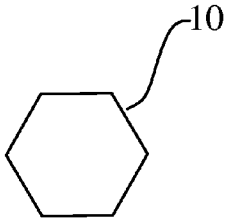

FIGS. 14A through 14I shows different cross-sectional views of a strand 10 that can be used to create the plurality of strands 10 of the first energy absorbing layer in accordance with various embodiments of the present invention. More specifically, FIG. 14A shows a circular cross-section for the strand 10. FIG. 14B shows an oval cross-section for the strand 10. FIG. 14C shows an elongated oval cross-section for the strand 10. FIG. 14D shows rectangular cross-section for the strand 10. FIG. 14E shows a rectangular cross-section for the strand 10, angled in a horizontal position. FIG. 14F shows a rectangular cross-section for the strand 10, angled in a tilted position. FIG. 14G shows a triangular cross-section for the strand 10. FIG. 10H shows a rectangular cross-section for the strand 10. Finally, FIG. 14I shows a hexagonal cross-section for the strands 10. It should be noted that the embodiments for the plurality of strands is merely illustrative, and not meant to be an exhaustive list; numerous other shapes and sizes can be used to create the strands all without departing from the scope and content of the present invention.

Figure 15A:
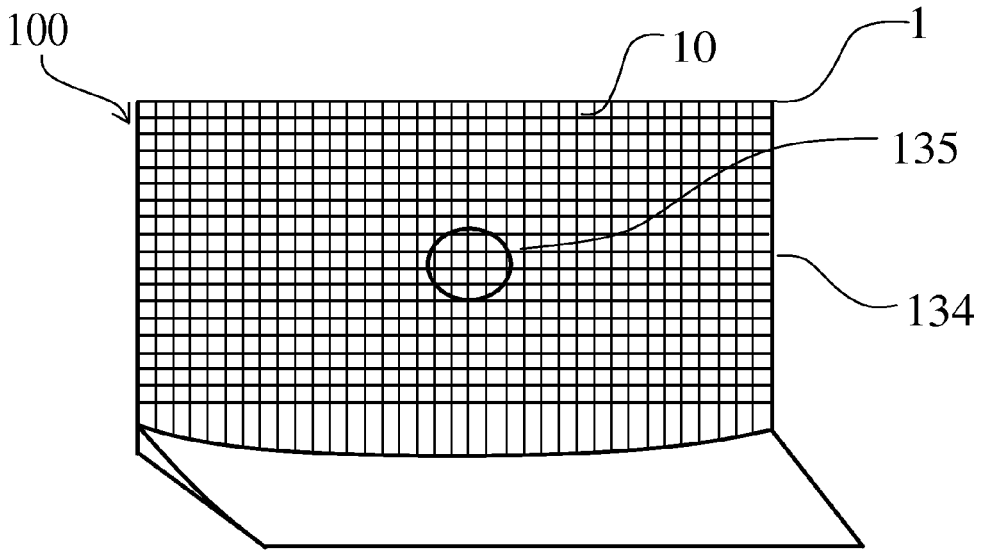
FIG. 15A shows a frontal perspective view of a golf ball catching apparatus in accordance with an even further alternative embodiment of the present invention.
Figure 15B:
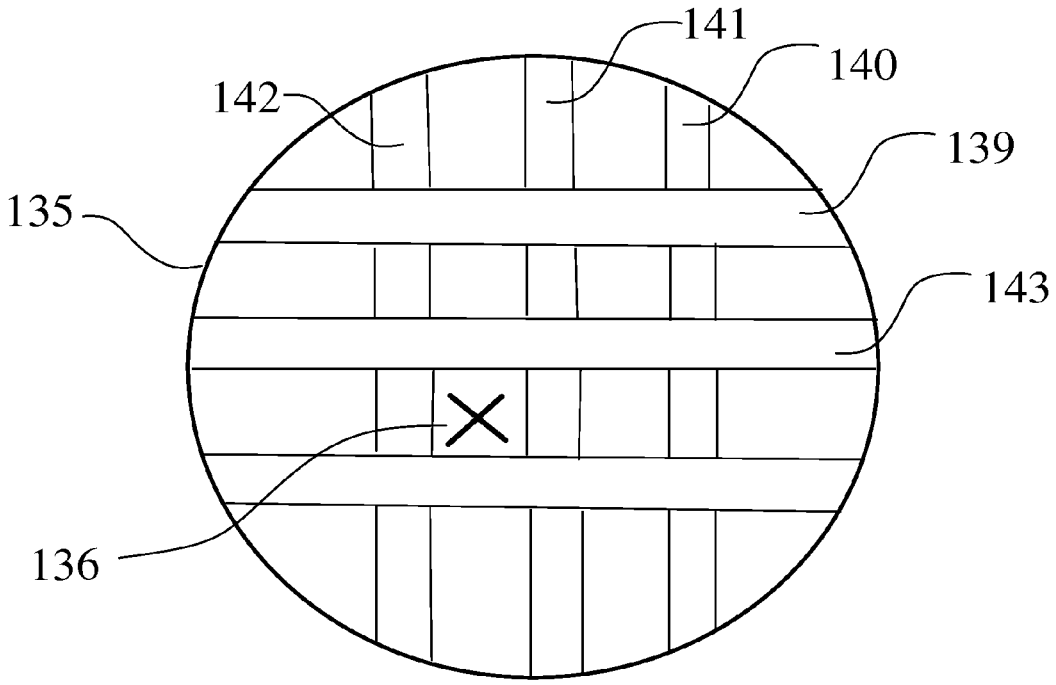
FIG. 15B shows an enlarged view of circular region 135 as shown in FIG. 15A.

FIG. 15A shows a golf ball catching apparatus 100 in accordance with a further alternative embodiment of the present invention. In this alternative embodiment of the present invention, the plurality of strands 10 that form the first energy absorbing layer 1 run both vertically and horizontally across the entire first energy absorbing layer 1. In this exemplary embodiment of the present invention, the gaps between the strands needs to be sufficiently large enough, or the tension of the plurality of strands 10 needs to be sufficiently great; to allow a golf ball to penetrate the first energy absorbing layer 1. FIG. 15B shows an enlarged view of the strands 10 in accordance with this alternative embodiment of the present invention, as highlighted by circular region 135.

As it can be seen from FIG. 15B illustrating the highlighted circular region 135, when a golf ball impacts this bidirectional strand combination at point 136, it will need to push apart both a horizontal strand as well as a vertical strand. This specific embodiment will generally allow the first energy absorbing layer 1 to absorb more energy than the unidirectional strand combination. However, caution must be taken to ensure that in this particular embodiment the tension of the strands and the gap between the strands are adjusted to prevent the golf ball from rebounding off the first energy absorbing layer 1 to hit a golfer.

It should be noted that the preferred embodiment of the present invention, as described by the previous figures, only have the plurality of strands 10 are parallel to one another and run in one substantially uniform direction. The unidirectional nature of the strands 10 is preferred because it allows for a golf ball to penetrate the first energy absorbing layer 1, which is an essential function of the present invention. If the plurality of strands run in both directions, or even worse, are interwoven, then the golf ball would rebound off the first energy absorbing layer 1, making it impractical for the current application.

The golf ball catching apparatus in accordance with the present invention may be modified to be used in the practice of other sports, like baseball and softball. The outer dimensions of the apparatus will not have to be modified much. However, the dimensions of the device, including the thickness of the cords, the distance between the cords, the distance between the different energy absorbing layers, and other minor features may need to be adjusted to accommodate the size and speed of the ball.

Other than in the operating example, or unless otherwise expressly specified, all of the numerical ranges, amounts, values and percentages such as those for amounts of materials, moment of inertias, center of gravity locations, loft, draft angles, various performance ratios, and others in the aforementioned portions of the specification may be read as if prefaced by the word "about" even though the term "about" may not expressly appear in the value, amount, or range. Accordingly, unless indicated to the contrary, the numerical parameters set forth in the above specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. A golf ball catching apparatus comprising:

a first energy absorbing layer located at a frontal portion of said golf ball catching apparatus;

a second energy absorbing layer located at a rear portion of said golf ball catching apparatus;

wherein said second energy absorbing layer is created from a material that absorbs and reduced the rebound energy of a golf ball, wherein said first energy absorbing layer further comprises a plurality of strands, wherein a tension within said plurality of strands are selected to slow down a golf ball when a struck golf ball initially penetrates said first energy absorbing layer, and so as to hinder said struck golf ball from re-penetrating said first energy absorbing layer after rebounding off said second energy absorbing layer, wherein said plurality of strands create a gap between said plurality of strands; and wherein said gap is greater than a diameter of said plurality of strands.

2. The golf ball catching apparatus of claim 1, wherein said first energy absorbing layer has a first energy absorption ratio and said second energy absorbing layer has a second energy absorption ratio, and wherein said first energy absorption ratio is lower than said second energy absorption ratio.

3. The golf ball catching apparatus of claim 2, wherein said first energy absorption ratio is about 1.16.

4. The golf ball catching apparatus of claim 3, wherein said second energy absorption ratio is about 2.40.

5. The golf ball catching apparatus of claim 2, wherein said second energy absorption ratio is greater than about two times than said first energy absorbing ratio.

6. The golf ball catching apparatus of claim 2, further comprising a frame, adapted to connect said first and second energy absorbing layer via a perimeter of said golf ball catching apparatus.

7. The golf ball catching apparatus of claim 6, wherein said first frame provides structural integrity to said first energy absorbing layer.

8. The golf ball catching apparatus of claim 2, further comprising an intermediate energy absorbing layer; wherein said intermediate energy absorbing layer is juxtaposed between said first energy absorbing layer and said second energy absorbing layer.

9. The golf ball catching apparatus of claim 8, wherein a distance between said first energy absorbing layer and said intermediate energy absorbing layer creates a gap, said distance of said gap is less than about 1.680 inches.

10. The golf ball catching apparatus of claim 8, wherein said golf ball pushes against said first energy absorbing layer and said intermediate energy absorbing layer as it falls down a gap to create a ripple effect.

11. The golf ball catching apparatus of claim 8, wherein said intermediate energy absorbing layer further comprises a plurality of strands, wherein a tension within said plurality of strands are selected to slow down a golf ball when a struck golf ball penetrates said intermediate energy absorbing layer, and also slow down a golf ball as said golf ball re-penetrates said intermediate energy absorbing layer after rebounding off said second energy absorbing layer.

* * * * *